US010244815B2

(12) United States Patent
Baucom et al.

(10) Patent No.: US 10,244,815 B2
(45) Date of Patent: Apr. 2, 2019

(54) FOOTWEAR SOLE STRUCTURE WITH CARRIER AND FRAME

(71) Applicant: NIKE, Inc., Beaverton, OR (US)

(72) Inventors: Jim Baucom, Portland, OR (US); Lysandre Follet, Portland, OR (US); Timothy Hanson, Portland, OR (US); James Molyneux, Portland, OR (US); Jeff Rasmussen, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 32 days.

(21) Appl. No.: 15/245,709

(22) Filed: Aug. 24, 2016

(65) Prior Publication Data

US 2017/0055634 A1 Mar. 2, 2017

Related U.S. Application Data

(60) Provisional application No. 62/209,534, filed on Aug. 25, 2015.

(51) Int. Cl.

| | |
|---|---|
| ***A43B 5/02*** | (2006.01) |
| ***A43B 13/04*** | (2006.01) |
| ***A43B 13/14*** | (2006.01) |
| ***A43B 3/00*** | (2006.01) |
| ***A43B 5/06*** | (2006.01) |
| ***A43B 1/00*** | (2006.01) |
| ***A43C 15/16*** | (2006.01) |
| ***A43B 3/12*** | (2006.01) |
| ***A43B 13/12*** | (2006.01) |
| ***A43B 13/22*** | (2006.01) |
| ***A43B 13/24*** | (2006.01) |

(52) U.S. Cl.

CPC ..... *A43B 5/02* (2013.01); *A43B 1/0009* (2013.01); *A43B 3/0047* (2013.01); *A43B 3/12* (2013.01); *A43B 5/06* (2013.01); *A43B 13/04* (2013.01); *A43B 13/125* (2013.01); *A43B 13/141* (2013.01); *A43B 13/223* (2013.01); *A43B 13/24* (2013.01); *A43C 15/16* (2013.01)

(58) Field of Classification Search

CPC ... A43B 1/0009; A43B 3/0047; A43B 13/023; A43B 13/12; A43B 13/122; A43B 5/00; A43B 5/065; A43B 5/14; A43C 15/16

USPC ..... 36/25 R, 30 R

See application file for complete search history.

(56) References Cited

U.S. PATENT DOCUMENTS 4,594,799 A * 6/1986 Lin ..... A43B 5/00 36/114
4,663,865 A * 5/1987 Telecemian ..... A43B 13/181 36/114
5,084,987 A * 2/1992 Flemming ..... A43B 1/0009 36/28

(Continued)

FOREIGN PATENT DOCUMENTS

WO 2013192259 A1 12/2013

OTHER PUBLICATIONS

International Search Report and Written Opinion of PCT/US2016/048325 dated Nov. 21, 2016.

*Primary Examiner* — Marie D Bays

(74) *Attorney, Agent, or Firm* — Banner & Witcoff, Ltd.

(57) ABSTRACT

A sole structure for an article of footwear may include a carrier and a frame. The frame may include walls that define cells. The carrier may cover the frame. The frame may be joined to and located on a top side of the carrier.

21 Claims, 21 Drawing Sheets

(56) References Cited

U.S. PATENT DOCUMENTS 5,839,208 A * 11/1998 Huang ..... A43B 13/186 36/28
5,946,824 A * 9/1999 Tighe ..... A43B 13/181 36/25 R
6,065,229 A * 5/2000 Wahrheit ..... A43B 13/00 36/25 R
6,367,172 B2 * 4/2002 Hernandez ..... A43B 1/0009 36/103
8,356,428 B2 * 1/2013 Auger ..... A43B 5/02 36/102
8,555,525 B2 * 10/2013 Mahoney ..... A43B 7/144 36/25 R
8,898,934 B2 * 12/2014 Auger ..... A43B 5/02 36/102
9,038,285 B2 * 5/2015 McDowell ..... A43B 13/122 36/28
9,119,438 B2 * 9/2015 Auger ..... A43B 1/0009
9,615,621 B2 * 4/2017 Foxen ..... A43B 5/02
9,681,703 B2 * 6/2017 Cross ..... A43B 13/223
9,839,255 B2 * 12/2017 Adami ..... A43B 5/02
2001/0032400 A1 * 10/2001 Brooks ..... A43B 13/12 36/102
2004/0205981 A1 * 10/2004 Cole ..... A43B 7/1415 36/30 R
2005/0108898 A1 * 5/2005 Jeppesen ..... A43B 1/0072 36/30 R
2005/0198863 A1 * 9/2005 Hockerson ..... A43B 5/06 36/30 R
2007/0277401 A1 12/2007 Young-Chul
2011/0179680 A1 * 7/2011 Miette ..... A43B 5/0411 36/30 R
2012/0180343 A1 7/2012 Auger et al.
2013/0318831 A1 * 12/2013 Foxen ..... A43B 5/02 36/25 R
2016/0157557 A1 * 6/2016 Cross ..... A43B 13/223 36/25 R

* cited by examiner (medial side)

(lateral side)

(medial side)

(top)

(bottom)

(toe)

(heel)

(top)

(bottom)

(top)

(top)

(bottom)

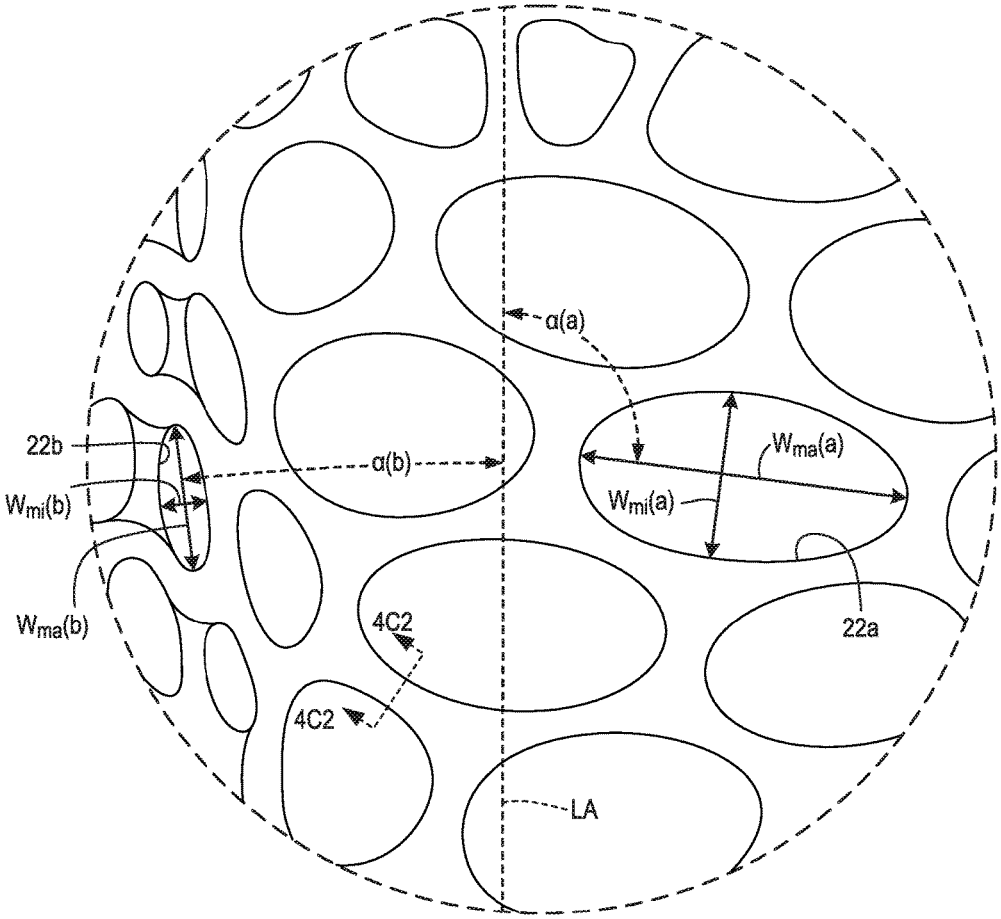
FIG. 4C1
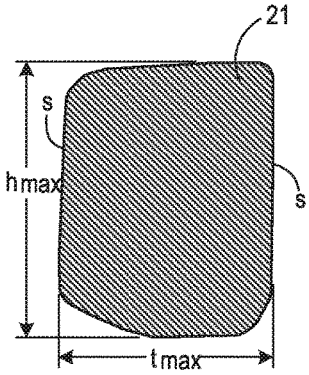
FIG. 4C2

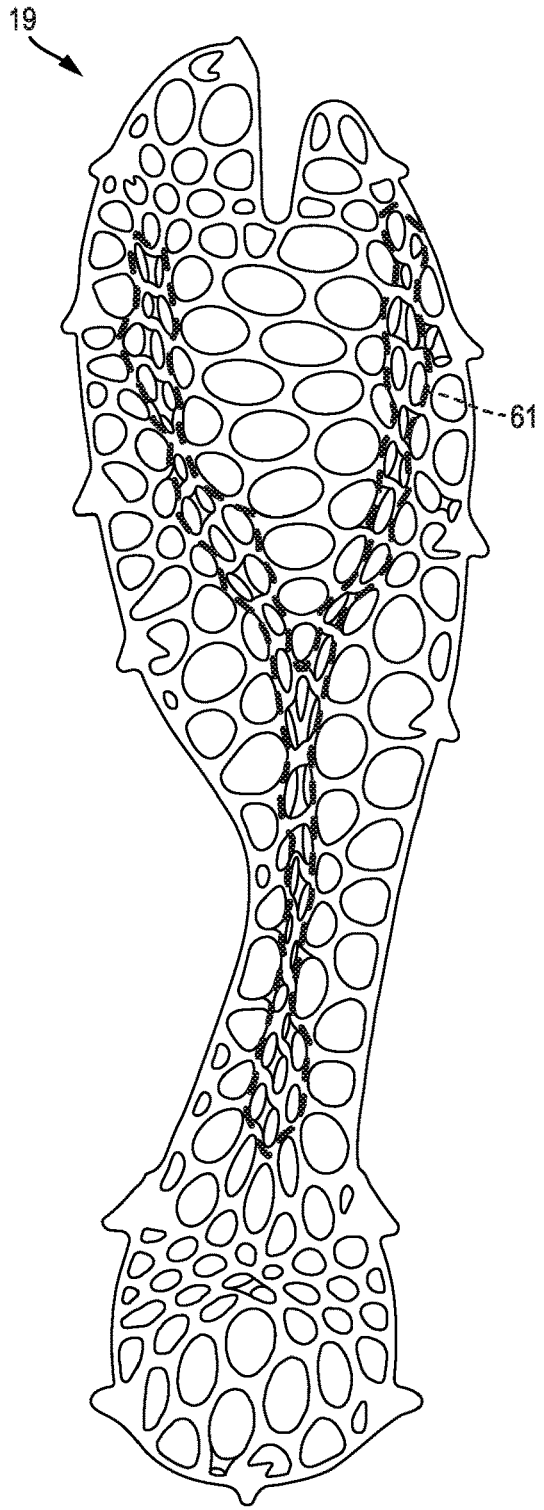
FIG. 4D1

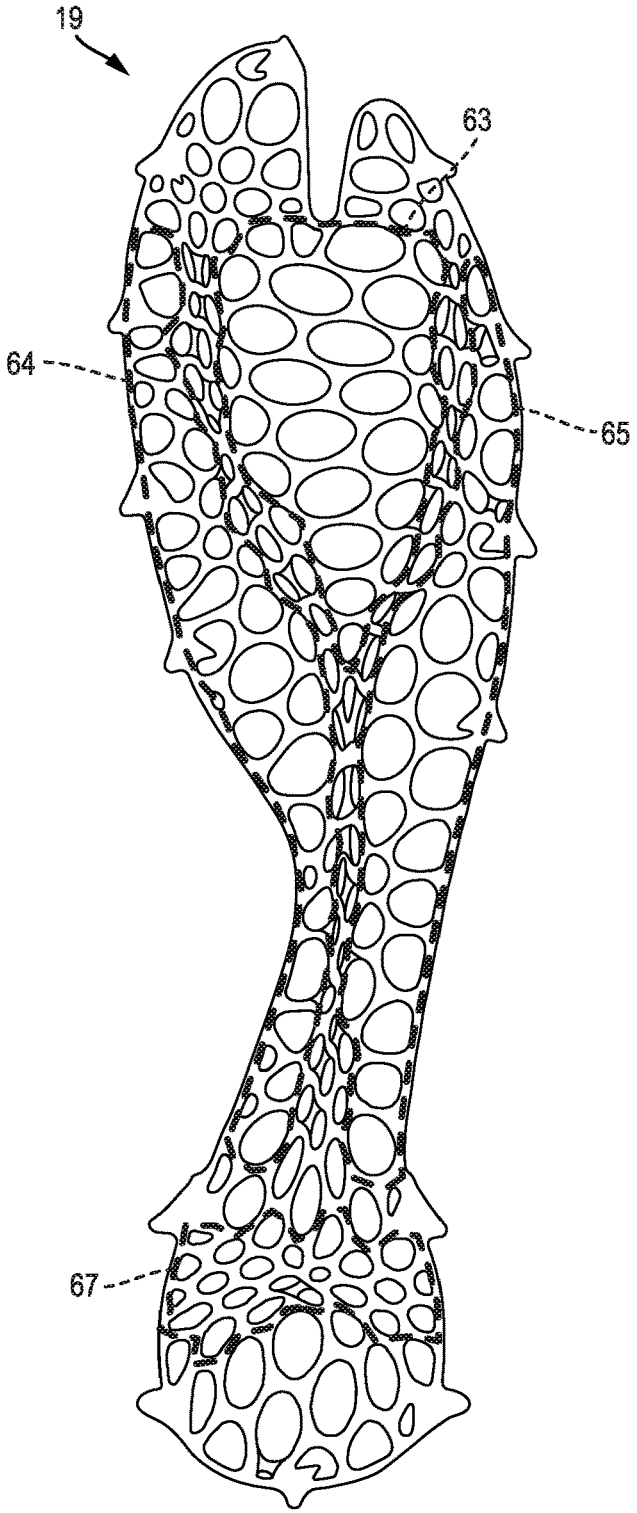
FIG. 4D2

(medial side)

(lateral side)

(toe)

(heel)

FOOTWEAR SOLE STRUCTURE WITH CARRIER AND FRAME

CROSS-REFERENCE TO RELATED APPLICATION

This application claims priority to U.S. provisional patent application No. 62/209,534, titled "Footwear Sole Structure With Carrier And Frame" and filed Aug. 25, 2015. Application No. 62/209,534, in its entirety, is incorporated by reference herein.

BACKGROUND

Conventional articles of footwear generally include an upper and a sole structure. The upper provides a covering for the foot and securely positions the foot relative to the sole structure. The sole structure is secured to a lower portion of the upper and is configured so as to be positioned between the foot and the ground when a wearer is standing, walking or running. Different sports and other physical activities cause differing patterns and/or intensities of forces on a foot of a participant.

BRIEF DESCRIPTION OF THE DRAWINGS

Some embodiments are illustrated by way of example, and not by way of limitation, in the figures of the accompanying drawings and in which like reference numerals refer to similar elements.

FIG. 4C1 is an enlarged view of the region indicated in FIG. 4A.

FIG. 4C2 is a further enlarged area cross-sectional view taken from the location indicated in FIG. 4C1.

FIGS. 4D1 and 4D2 are top views similar to FIG. 4A, but with certain regions indicated.

DETAILED DESCRIPTION

Figure 1A:
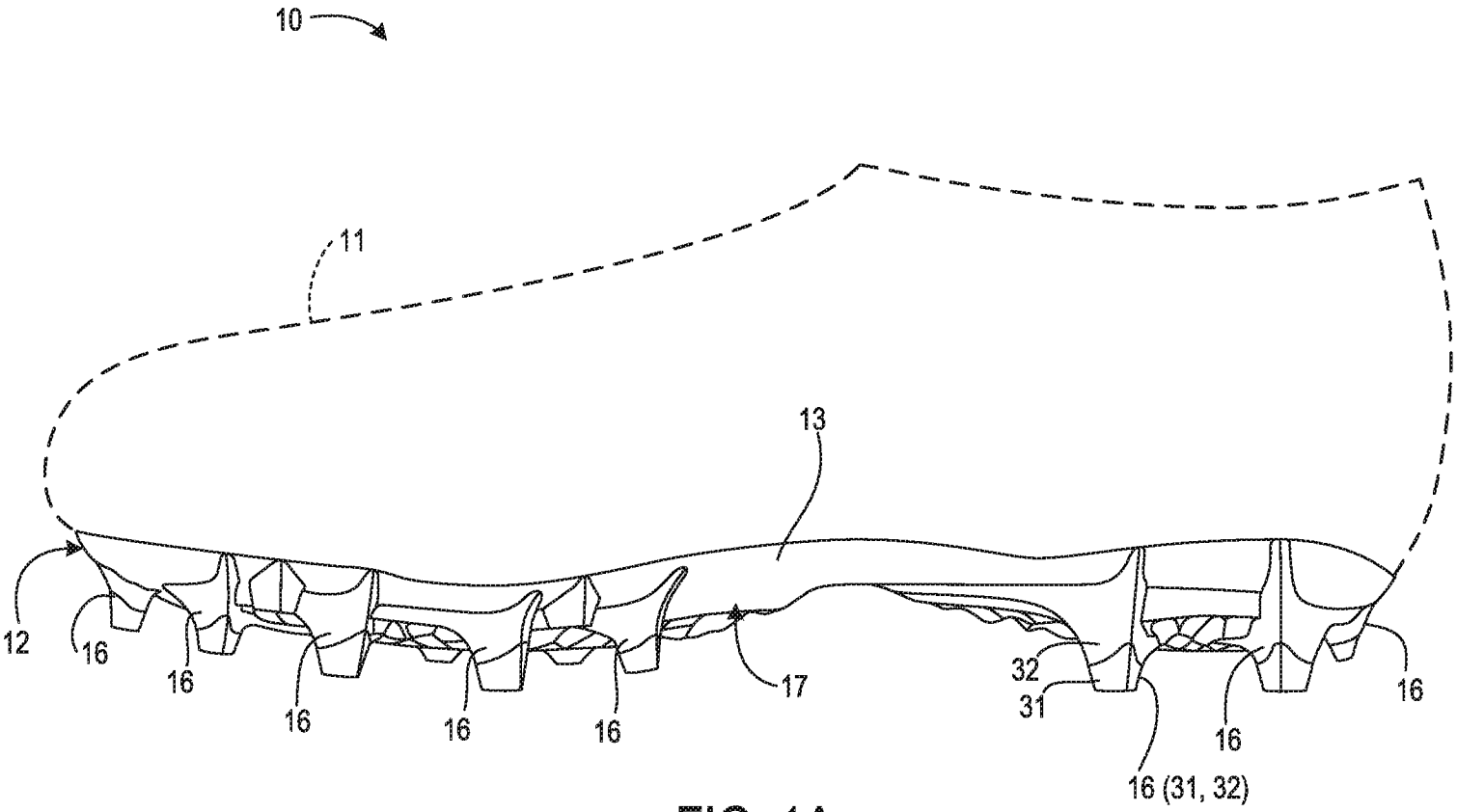
FIG. 1A is a medial side view of an article of footwear according to some embodiments.

Different sports and other physical activities cause differing patterns and/or intensities of forces on a foot of a participant. A stiffness profile that is beneficial in a sole structure of a shoe for one sport or activity may be less beneficial (or perhaps even harmful) in a sole structure of a shoe for a different sport of activity. Applicant has determined that footwear sole structures having configurations that permit adaptation to different types of sports or activities would be beneficial.

In at least some embodiments, a sole structure for an article of footwear has a configuration that facilitates design modifications to tune a stiffness profile for a particular sport or activity. A first part of the sole structure may comprise a frame having walls that define cells. A second part of the sole structure may include a carrier that covers the frame to prevent accumulation of debris within the frame and/or to protect the frame from damage. Utilizing this general configuration of a frame and carrier, sole structures for different activities can readily be designed by selecting sizes, shapes, and/or arrangements of cells, and/or height and/or thickness of walls in various regions, to achieve a desired combination of stiffness in some regions and/or flexibility in other regions.

The accompanying drawings show a sole structure designed for footwear worn by a participant in American style football. However, other embodiments include sole structures and footwear intended for use in other sports or activities, and which include different stiffness profiles.

In at least some embodiments, a sole structure for an article of footwear may include a carrier. The carrier may have a bottom side and a top side. The sole structure may also include a frame. The frame may be attached to the carrier top side and may include a matrix of interconnected walls defining a plurality of cells.

In some embodiments, the carrier may overlay at least a portion of the cells. At least some of the cells may varied with respect to at least one of size, shape, alignment, and spacing, and/or at least some of the walls may be varied with respect to wall height and wall thickness, so as to define one or more regions of increased stiffness and one or more regions of reduced stiffness. The carrier may have a shape corresponding to at least a portion of a footwear sole.

In some embodiments, a sole structure may include a carrier having a bottom side and a top side. The sole structure may include a frame attached to the carrier top side and that includes interconnected walls defining a plurality of cells. Cells and/or walls of the first region may have a configuration different from a configuration of cells and/or walls of the second region. The first region may have a stiffness different from a stiffness of the second region as a result of the differences in configuration.

In some embodiments, a sole structure may include a carrier having a bottom side and a top side. The carrier may further include a frame attached to the carrier top side and including a matrix of interconnected walls defining a plurality of non-uniform cells.

Additional embodiments are described herein.

To assist and clarify subsequent description of various embodiments, various terms are defined herein. Unless context indicates otherwise, the following definitions apply throughout this specification (including the example embodiments included in the list of example embodiments attached hereto). "Shoe" and "article of footwear" are used interchangeably to refer to an article intended for wear on a human foot. A shoe may or may not enclose the entire foot of a wearer. For example, a shoe could be a sandal or other article that exposes large portions of a wearing foot. The "interior" of a shoe refers to space that is occupied by a wearer's foot when the shoe is worn. An interior side, surface, face, or other aspect of a shoe component refers to a side, surface, face or other aspect of that component that is (or will be) oriented toward the shoe interior in a completed shoe. An exterior side, surface, face or other aspect of a component refers to a side, surface, face or other aspect of that component that is (or will be) oriented away from the shoe interior in the completed shoe. In some cases, the interior side, surface, face or other aspect of a component may have other elements between that interior side, surface, face or other aspect and the interior in the completed shoe. Similarly, an exterior side, surface, face or other aspect of a component may have other elements between that exterior side, surface, face or other aspect and the space external to the completed shoe.

Shoe elements can be described based on regions and/or anatomical structures of a human foot wearing that shoe, and by assuming that the interior of the shoe generally conforms to and is otherwise properly sized for the wearing foot. A forefoot region of a foot includes the phalanges, as well as the heads and bodies of the metatarsals. A forefoot element of a shoe is an element having one or more portions located under, over, to the lateral and/or medial side of, and/or in front of a wearer's forefoot (or portion thereof) when the shoe is worn. A midfoot region of a foot includes the cuboid, navicular, and cuneiforms, as well as the bases of the metatarsals. A midfoot element of a shoe is an element having one or more portions located under, over, and/or to the lateral and/or medial side of a wearer's midfoot (or portion thereof) when the shoe is worn. A heel region of a foot includes the talus and the calcaneus. A heel element of a shoe is an element having one or more portions located under, to the lateral and/or medial side of, and/or behind a wearer's heel (or portion thereof) when the shoe is worn. The forefoot region may overlap with the midfoot region, as may the midfoot and heel regions.

For purposes of describing axes and directions for a sole structure, it is assumed that surfaces of a sole structure intended for ground contact are resting on a horizontal reference plane. It is further assumed that cleats or other projections from a bottom side of a sole structure do not penetrate that reference plane, and that the sole structure is not deformed. A longitudinal axis refers to a horizontal heel-toe axis that extends from a forwardmost toe location on a sole structure ("FT" in FIGS. 2E and 2F) to a rearmost heel location on a sole structure ("RH" in FIGS. 2E and 2F). A longitudinal axis may be inclined with regard to the reference plane. A longitudinal direction is parallel to the longitudinal axis. A transverse axis is an axis that intersects and is perpendicular to the longitudinal axis, and that is also parallel to the reference plane. A transverse direction is a direction along a transverse axis.

"Upper," when used as a noun, refers to a portion of a shoe that provides a covering for some or all of a wearer's foot and that positions that foot relative to a sole structure of that shoe. A "bottom side" of a sole structure refers to a side of a sole structure that faces towards the reference plane and/or away from the upper. A "top side" of a sole structure refers to a side of a sole structure that faces toward the shoe upper and/or away from the reference plane.

Figure 1B:
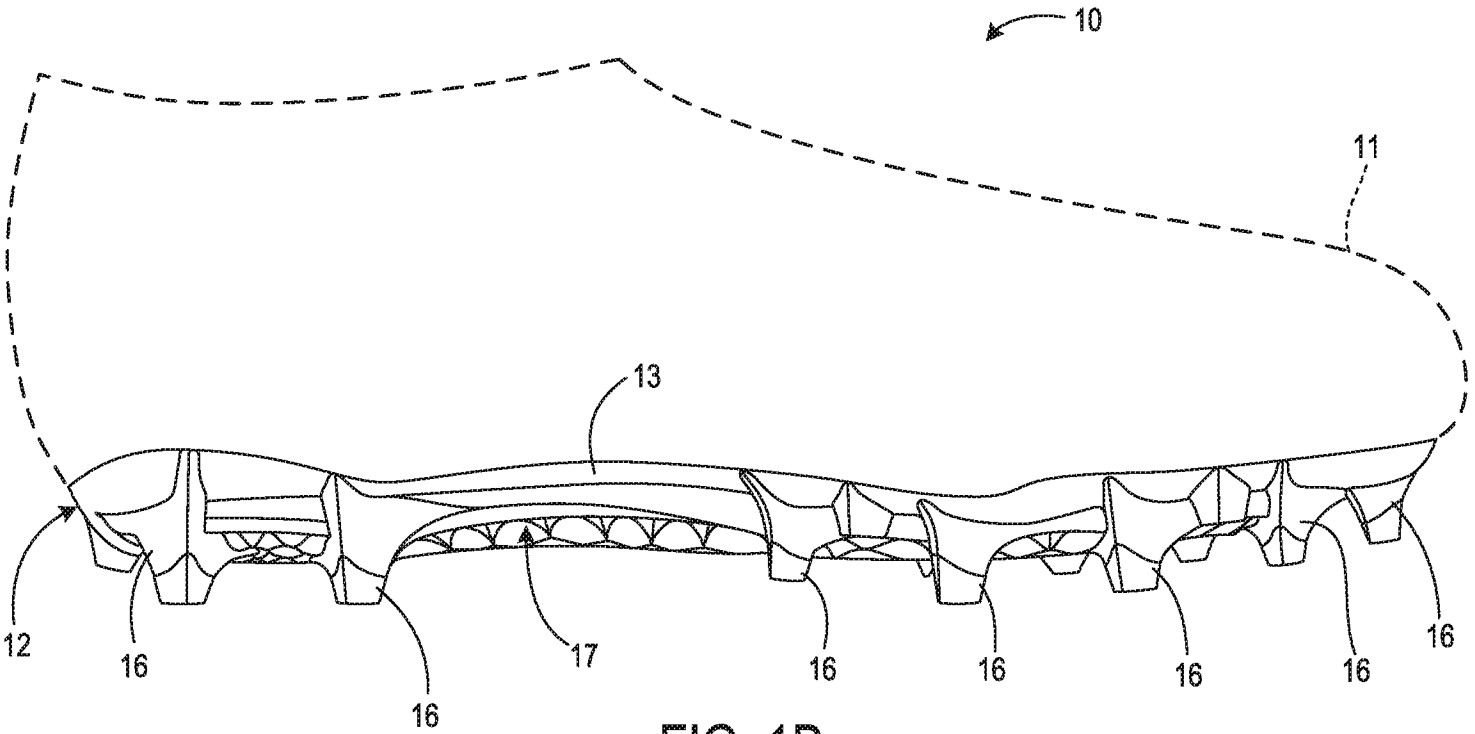
FIG. 1B is a lateral side view of the article of footwear of FIG. 1A.

FIG. 1A is a medial side view of a shoe 10 according to some embodiments. FIG. 1B is a lateral side view of shoe 10. Shoe 10 is configured for wear on a right foot and is part of a pair that includes a shoe (not shown) that is a mirror image of shoe 10 and configured for wear on a left foot. Shoe 10 includes an upper 11 and a sole structure 12. Upper 11 may be formed from any of various types or materials and have any of a variety of different constructions. Shoes according to various embodiments may include sole structures having features such as those described herein combined with any of various types of upper. Accordingly, upper 11 is shown generically in FIGS. 1A through 1C as a broken line silhouette.

Figure 1C:
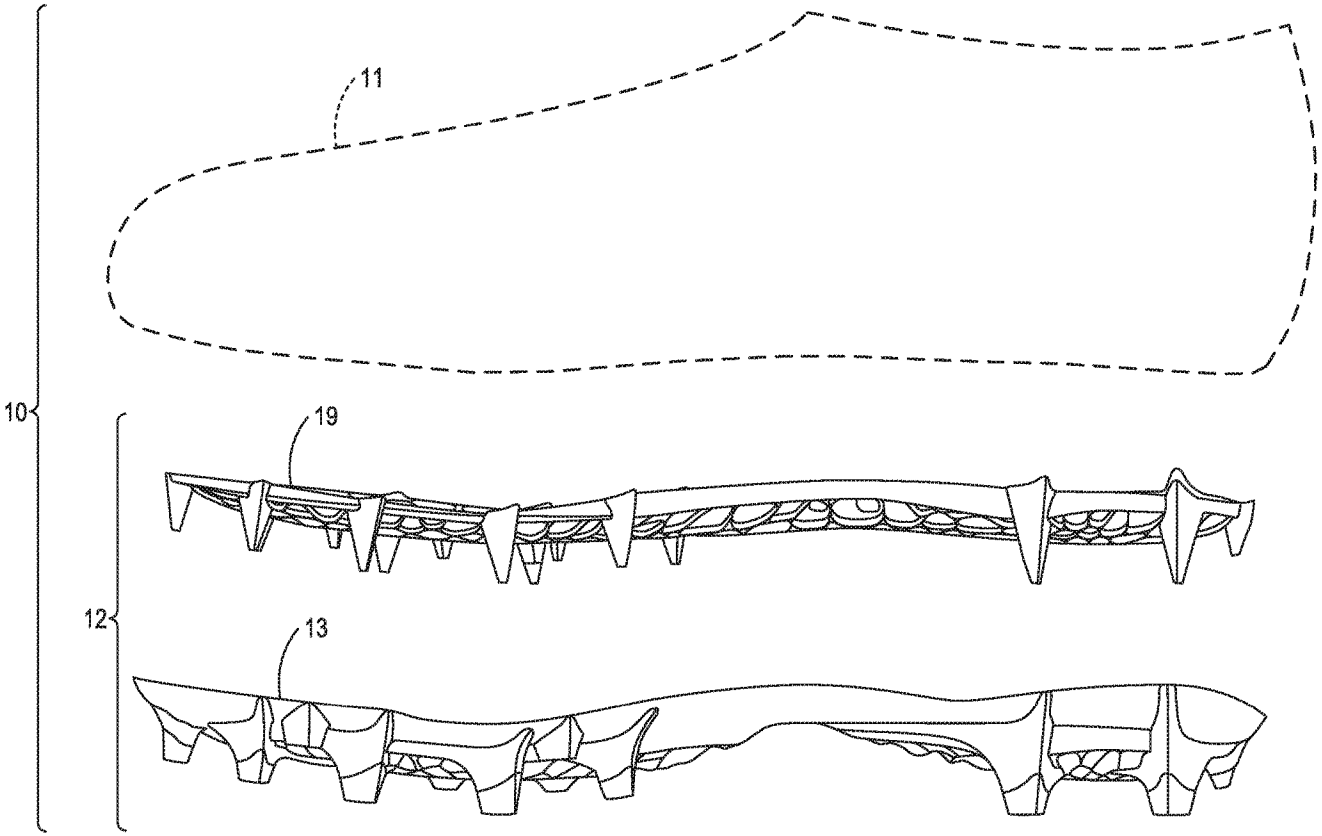
FIG. 1C is a medial side exploded view of the article of footwear from FIG. 1A.

Sole structure 12 is joined to upper 11. FIG. 1C is a medial side exploded view of shoe 10. As shown in FIG. 1C, and as is explained in more detail below, sole structure 12 includes a carrier 13 and a frame 19. Although carrier 13 and frame 19 are shown as separate components in FIGS. 1C and 1*n* other drawing figures, carrier 13 and frame 19 may be a unitary component formed by, e.g., multi-shot injection molding. In the embodiment of shoe 10, sole structure 12 does not include a separate midsole. A top side of frame 19 and portions of a top side of carrier 13 are bonded directly to a lasting element (e.g., a strobel) sewn to the lower perimeter of upper 11, as well as portions of upper 11 adjacent to that lower perimeter. In some embodiments, sole structure 12 may include a midsole and/or other components. For example, carrier 13 and/or frame 19 could be bonded or otherwise joined to a bottom side of a polymer foam midsole, and a top side of that midsole could be bonded or otherwise joined to a lasting element sewn to the lower perimeter of upper 11.

The bottom side of sole structure 12 includes a plurality of primary outsole projections 16 and a plurality of smaller secondary outsole projections. The secondary outsole projections are obscured in FIGS. 1A and 1B but are shown in subsequent figures. Each of primary outsole projections 16 and the secondary outsole projections extends downward from surrounding portions of a bottom side 17 of carrier 13. In the embodiment of shoe 10, primary outsole projections 16 are cleats with sizes, shapes, and an arrangement selected for a player of American style football. In other embodiments, however, a shoe may be configured for wear by a participant in another type of sport or activity. Shoes according to such other embodiments may have other sizes, shapes, and/or arrangements of outsole projections, or may lack outsole projections. As indicated for one of primary outsole projections 16 in FIG. 1A, and as discussed below, each primary outsole projections 16 includes a base portion 32 and a traction element end portion 31.

Figure 2A:
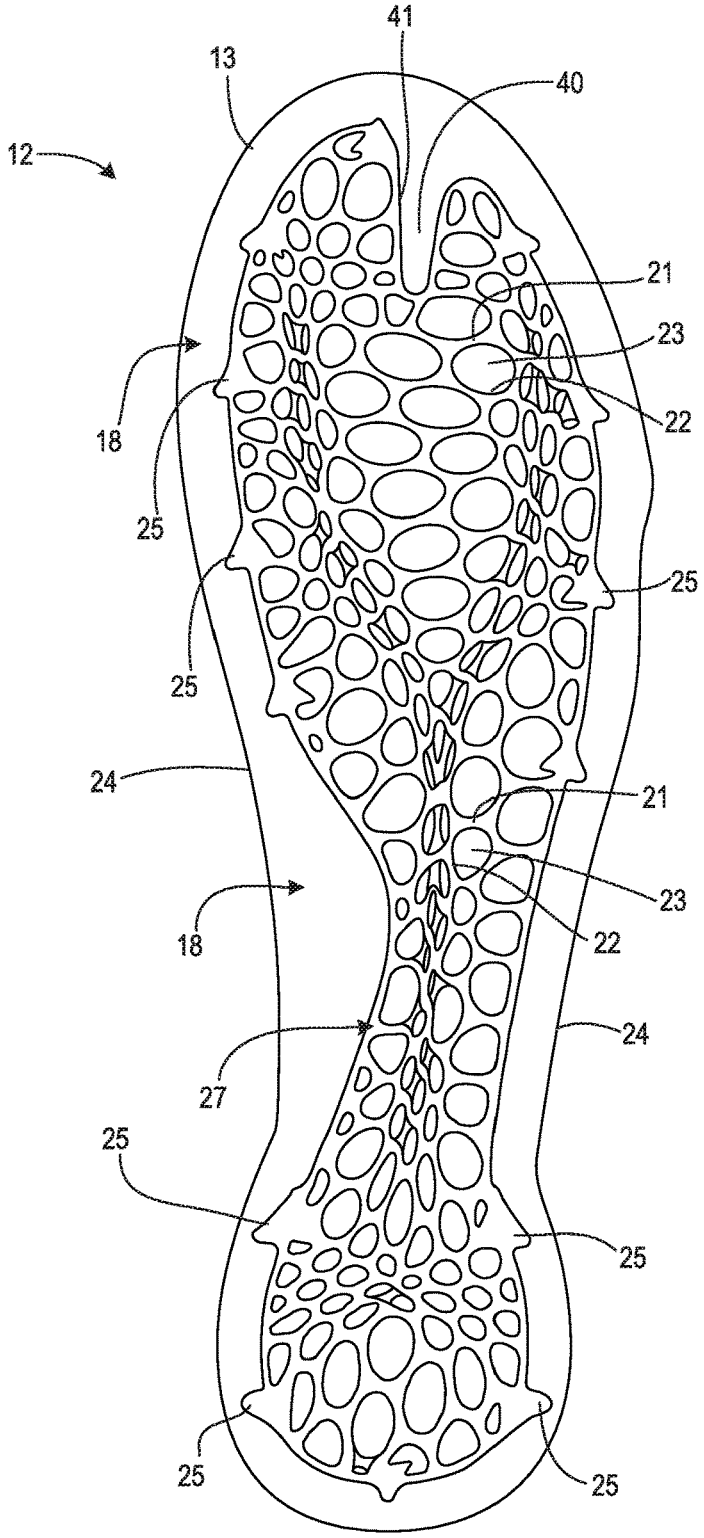
FIG. 2A is a top side view of a sole structure from the article of footwear of FIG. 1A.

FIG. 2A is a top view of sole structure 12 isolated from upper 11 and showing frame 19. Visible in FIG. 2A are a portions of a top side 18 of carrier 13, as well as a top side 27 of frame 19. Frame 19 includes a matrix of interconnected walls 21 defining non-uniform cells 22. For convenience, only a few of walls 21 and cells 22 are marked in FIG. 2A.

Frame 19 is attached to top side 18 of carrier 13. Rounded protrusions 23 are formed in top side 18 and project into corresponding cells 22. Each of protrusions 23 has a peripheral shape that matches a shape of the corresponding cell 22 into which the protrusion projects. As a result, protrusions 23 may help reinforce frame 19 relative to carrier 13 and thereby help stabilize frame 19 relative to carrier 13. In the embodiment of shoe 10, top side 18 of carrier 13 includes a protrusion 23 corresponding to each of cells 22, with each of protrusions 23 having a corresponding concavity (described below) on bottom side 17 of carrier 13. In other embodiments, a carrier may lack protrusions and/or concavities in positions corresponding to some cells of a frame.

An outermost edge 24 defines a peripheral boundary of carrier 13. A peripheral boundary of frame 19 is defined by outer edges of outermost walls 21 and by outer edges of top portions of primary posts 25. As explained below, each of primary posts 25 extends downward into carrier 13 and into one of primary outsole projections 16. In the embodiment of shoe 10, the peripheral boundary of frame 19 is completely contained within the peripheral boundary of carrier 13. In other embodiments, however, some or all portions of a frame peripheral boundary may be located outside a peripheral boundary of a carrier.

Figure 2B:
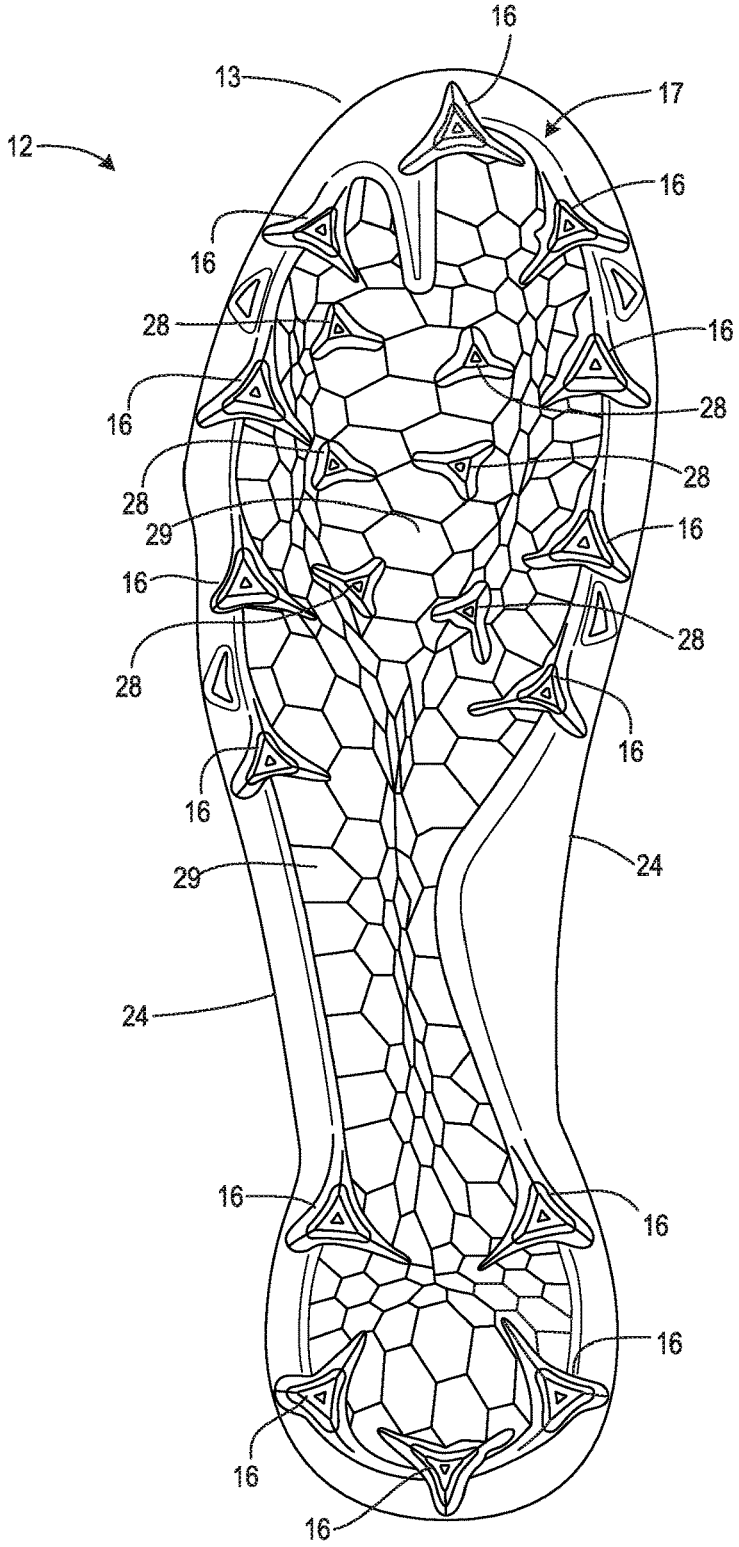
FIG. 2B is a bottom side view of the sole structure from the article of footwear of FIG. 1A.

FIG. 2B is a bottom side view of sole structure 12 and shows bottom side 17 of carrier 13 in more detail. In addition to primary outsole projections 16, bottom side 17 further includes the previously-mentioned secondary outsole projections 28. Each secondary outsole projection 28 may also include a base portion and a traction element end portion. Bottom side 17 also includes numerous rounded concavities 29, the edges of which form a series of ridge surface features to further increase traction during wear of shoe 10. Each of concavities 29 corresponds to, and is the underside of, one of protrusions 23 on top side 18 of carrier 13. Each of primary outsole projections 16 corresponds to, and has a position aligned with, one of primary posts 25 of frame 19. Similarly, each of secondary outsole projections 28 corresponds to and has a position aligned with one of several smaller secondary projections on the bottom side of frame 19.

Figure 2C:
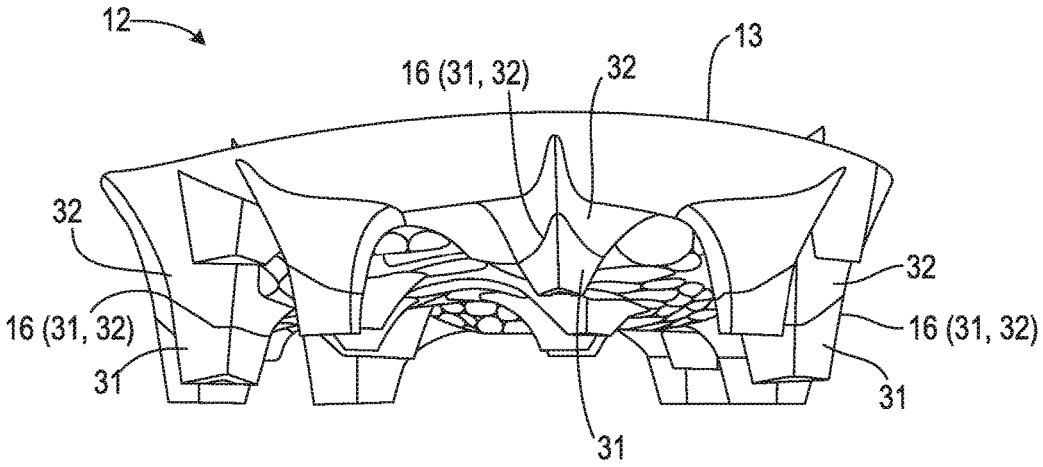
FIG. 2C is a front view showing the toe of the sole structure from the article of footwear of FIG. 1A.
Figure 2D:
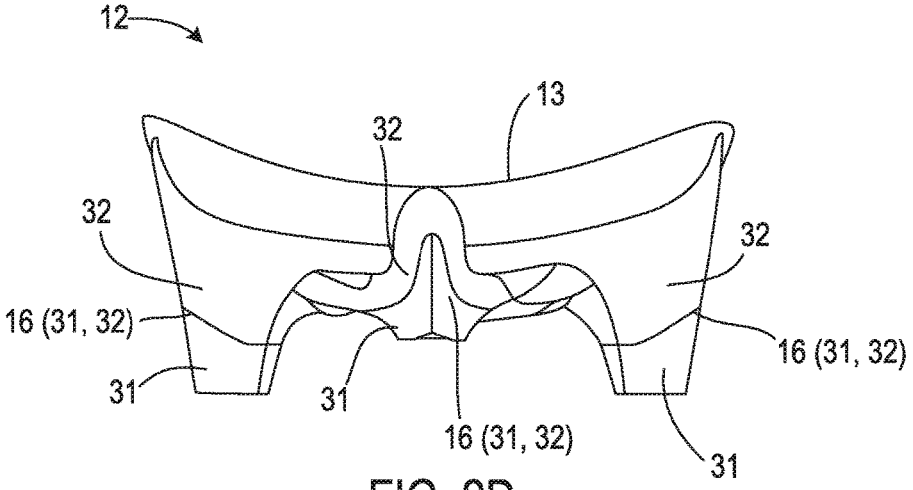
FIG. 2D is a rear view showing the heel of the sole structure from the article of footwear of FIG. 1A.

FIG. 2C is an enlarged front view of sole structure 12 showing a toe region. FIG. 2D is an enlarged rear view of sole structure 12 showing a heel region. In the embodiment of shoe 10, end portions 31 of primary outsole projections 16 are formed from a first material and the remainder of carrier 13, including top portions 32 of primary outsole projections 16, is formed from a second material. The first material may have increased harness and/or abrasion resistance relative to the second material. Alternatively, the first material may be softer than the second material so as to increase traction. In some embodiments, the first material may be thermoplastic polyurethane (TPU) and/or another polymer. In some embodiments, the first material may be an elastomeric material. Exemplary second materials for the remainder of carrier 13 may include TPU, polyether block amide (PEBA), and/or other materials.

Figure 2E:
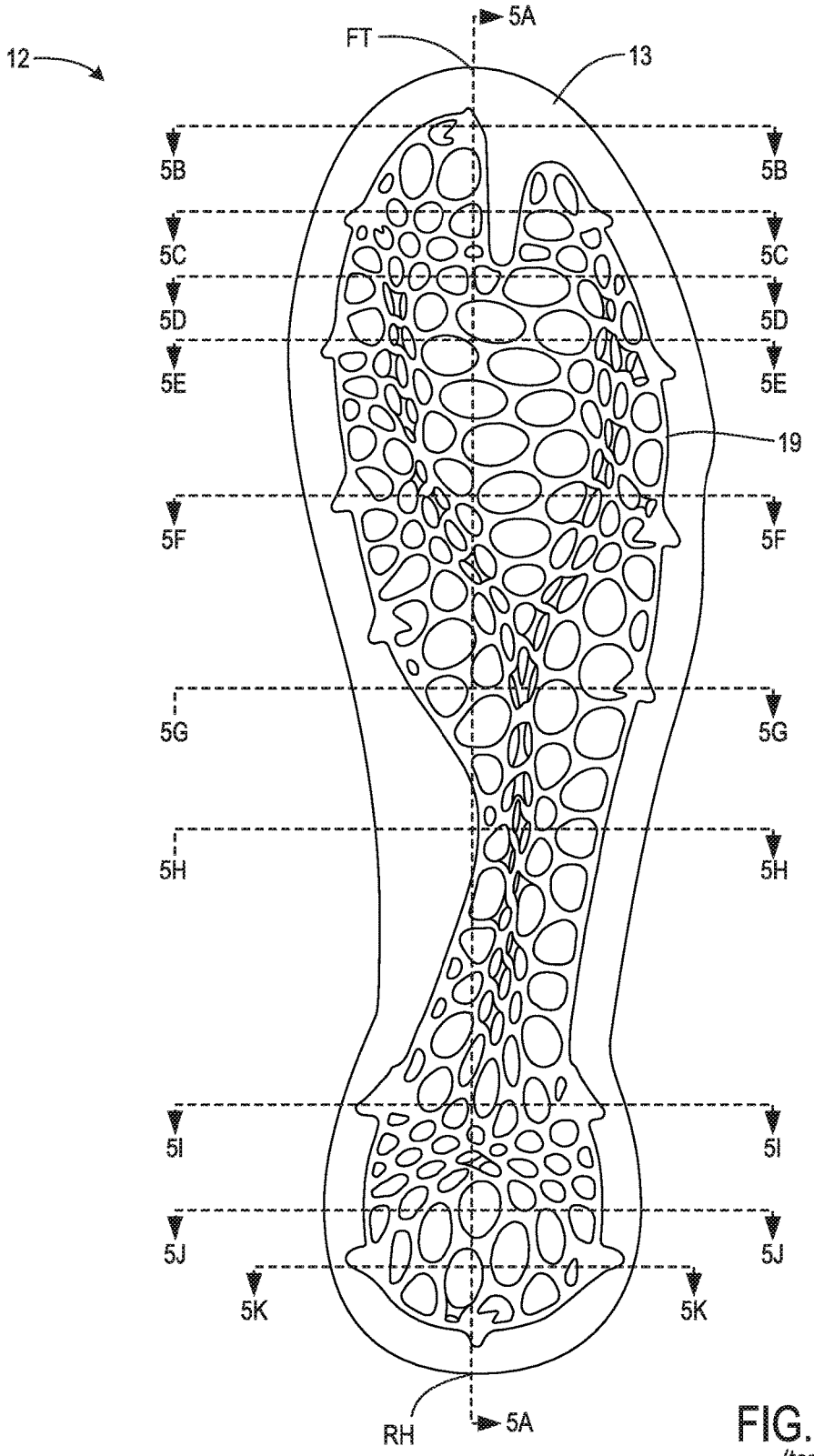
FIGS. 2E and 2F are respective top side and bottom side views similar to FIGS. 2A and 2B and showing locations of sectioning planes.
Figure 2F:
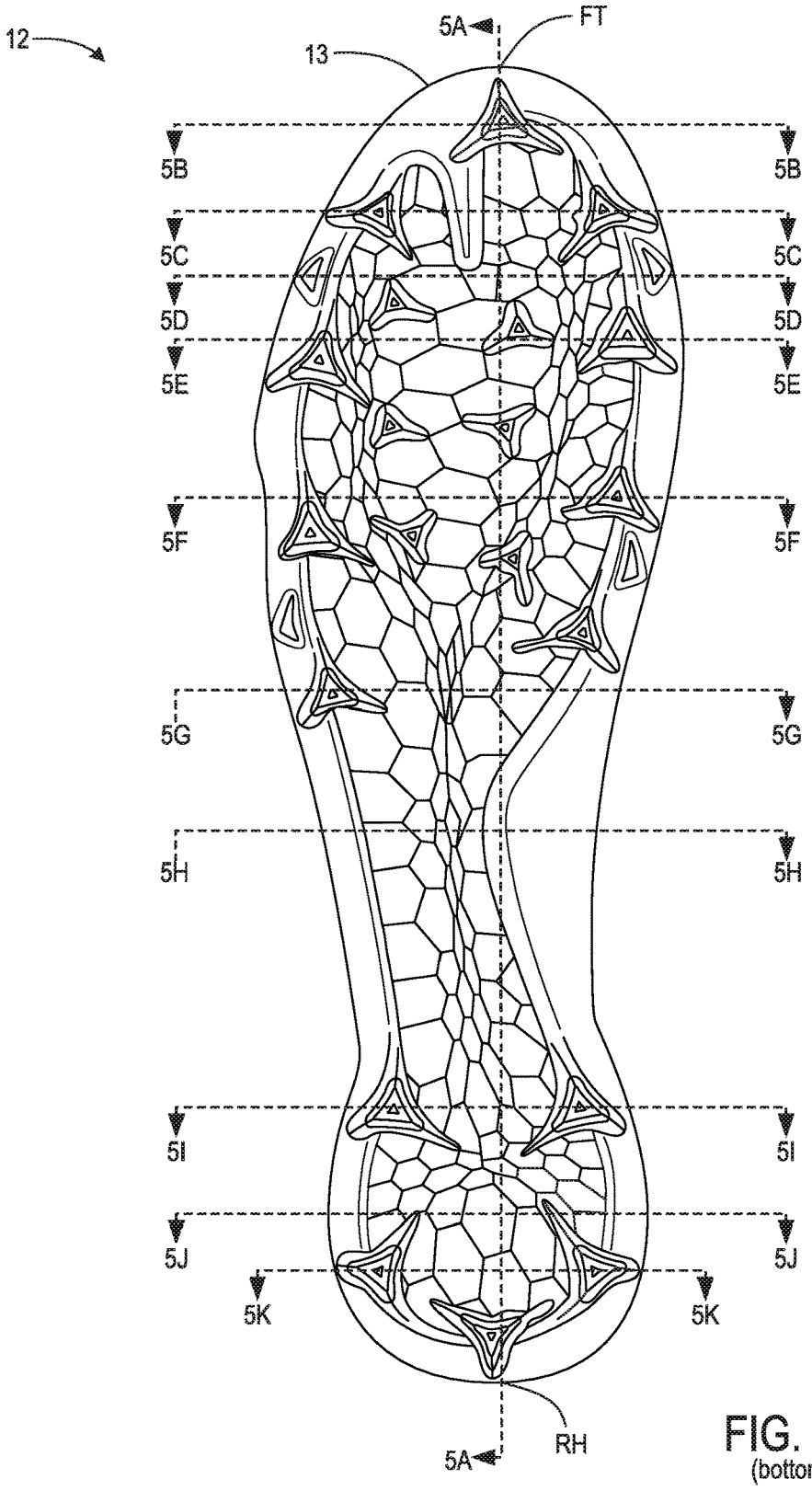

FIGS. 2E and 2F are additional top and bottom views, respectively, of sole structure 12. FIGS. 2E and 2F are similar to FIGS. 2A and 2B, but include lines to indicate the locations of sectioning planes for area cross-sectional views in FIGS. 5A through 5K. A sectioning plane identified with figure number in FIG. 2E is the same as a sectioning plane identified with that same figure number in FIG. 2F. For example, sectioning plane 5A-5A of FIG. 2E is the same as sectioning plane 5A-5A of FIG. 2F. Notably, sectioning plane 5A-5A also passes through the longitudinal axis of sole structure 12, as indicated in FIGS. 2E and 2F by the positions of forwardmost toe location FT and rearmost heel location RH.

Figure 3:
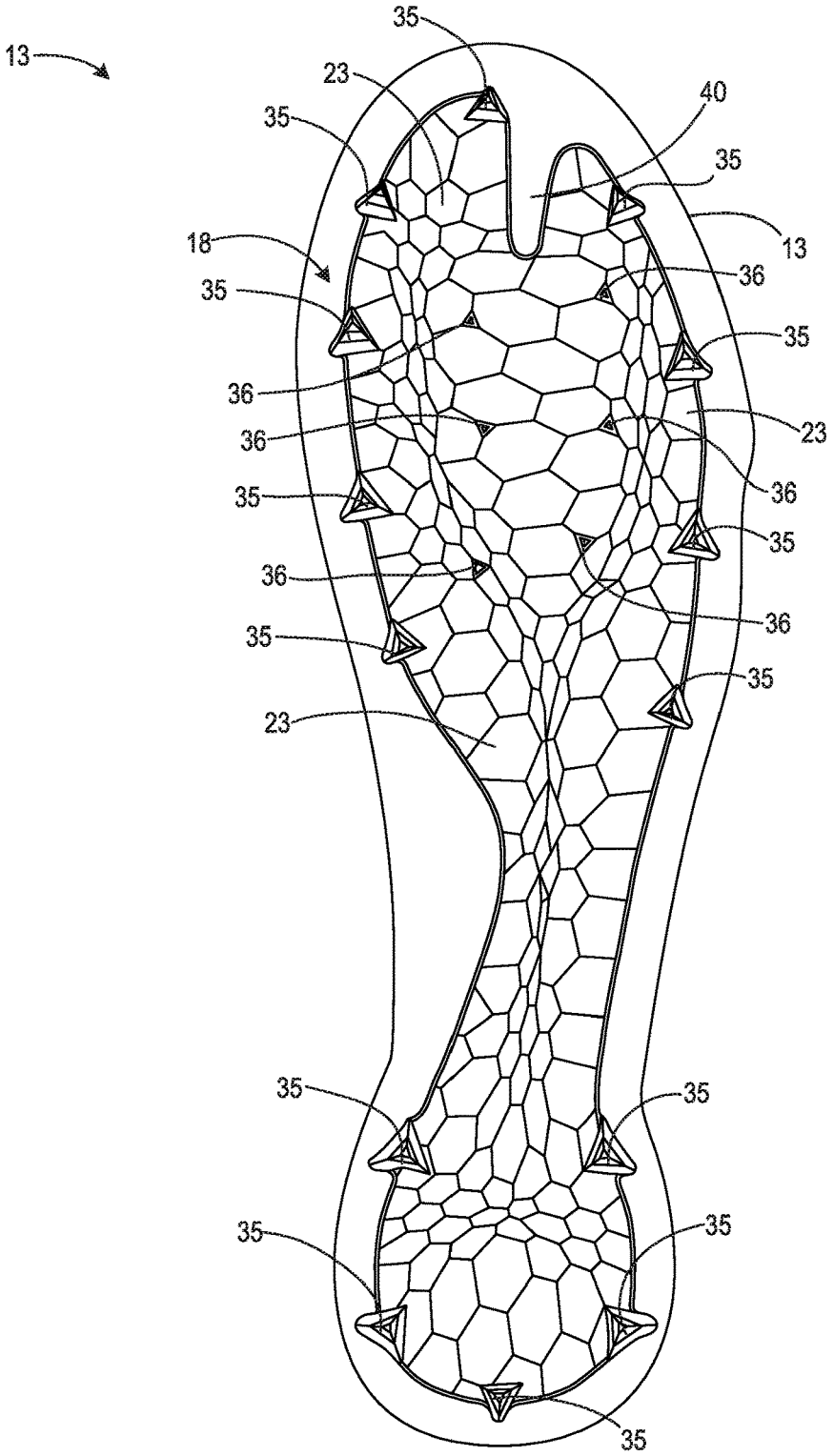
FIG. 3 is a top view of a carrier from the sole structure of FIGS. 2A-2F.

FIG. 3 is a top view of carrier 13 alone and shows all of top side 18. Carrier 13 has a shape corresponding to a sole of shoe 10. In other embodiments, a carrier may have a shape corresponding to less than an entire sole. As but some examples, carriers in various embodiments may be limited to and correspond to the shape(s) of a forefoot region, forefoot and midfoot regions, a heel region, a lateral side region, a medial side region, etc.

As indicated above, and as seen in more detail in FIG. 3, rounded protrusions 23 are formed in top side 18 of carrier 13. Valleys between protrusions 23 are joined to edges of walls 21 on the bottom side of frame 19. Also visible in FIG. 3 are primary receptacles 35 and secondary receptacles 36 formed in carrier 13. Each of primary receptacles 35 corresponds to, and extends through, one of primary outsole projections 16. Each of primary receptacles 35 receives one of primary posts 25 of frame 19 when sole structure 12 is formed. As discussed below in further detail in connection with FIGS. 5A-5C, 5E-5G, 5I, and 5K, each of primary outsole projections 16 is thereby reinforced by a portion of a primary post 25. Each of secondary receptacles 36 corresponds to one of secondary outsole projections 28. When sole structure 12 is formed, secondary posts on the bottom side of frame 19 in a central forefoot region extend into secondary receptacles 36 and secondary outsole projections 28. Carrier 13 includes small openings in the bottom of primary receptacles 35 and secondary receptacles 36, which openings are filled by ends of primary posts 25 and ends of the secondary posts, respectively, upon forming of sole structure 12. In other embodiments, some or all of primary receptacles 35 and/or secondary receptacles 36 may lack openings.

Carrier 13 further includes an interphalangeal ridge 40 that approximately corresponds to regions between the first (big) and second toes of the foot of a shoe 10 wearer. As seen in FIG. 2A, ridge 40 nests within an interphalangeal gap 41 formed in frame 19.

Figure 4A:
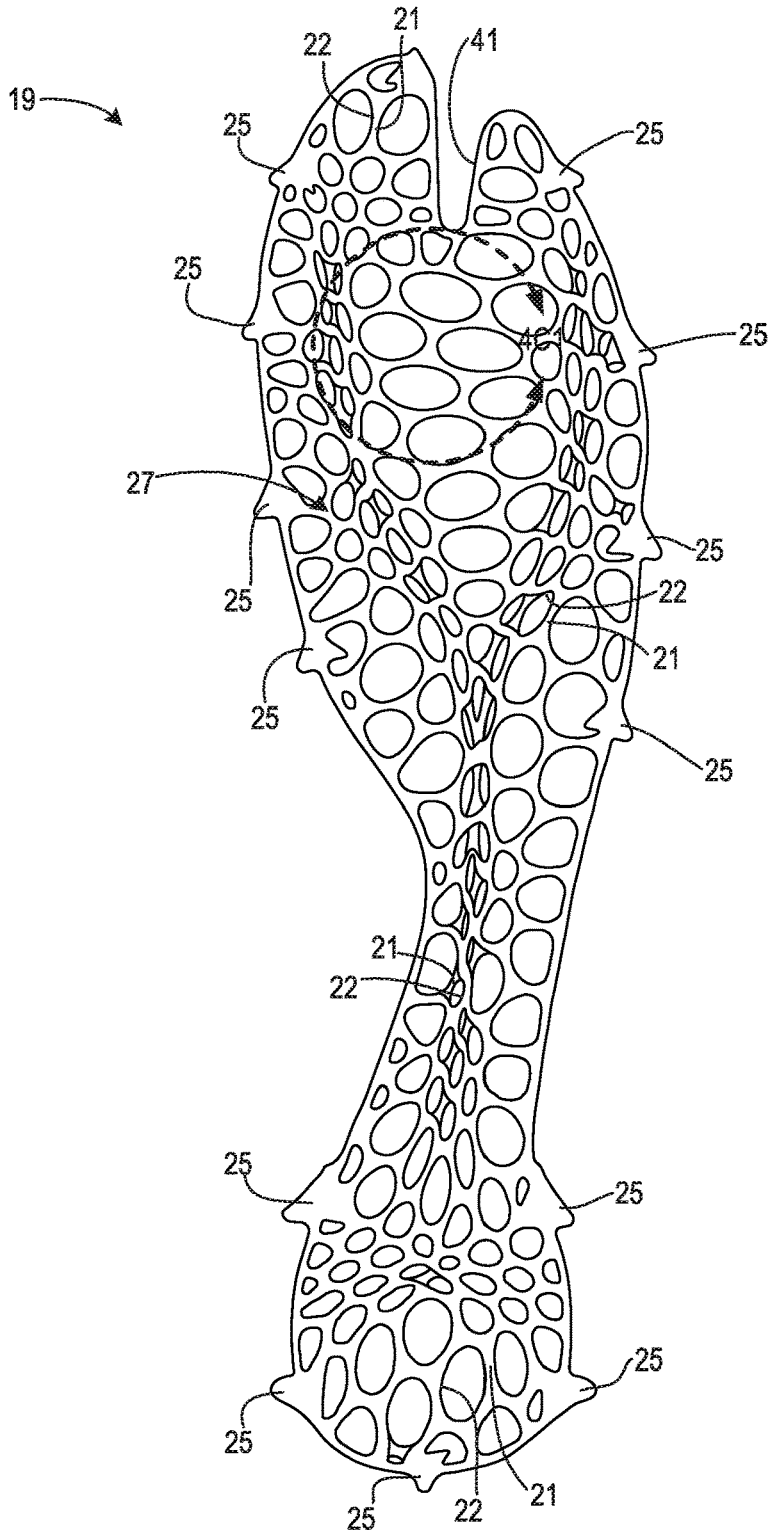
FIG. 4A is a top view of a frame from the sole structure of FIGS. 2A-2F.
Figure 4B:
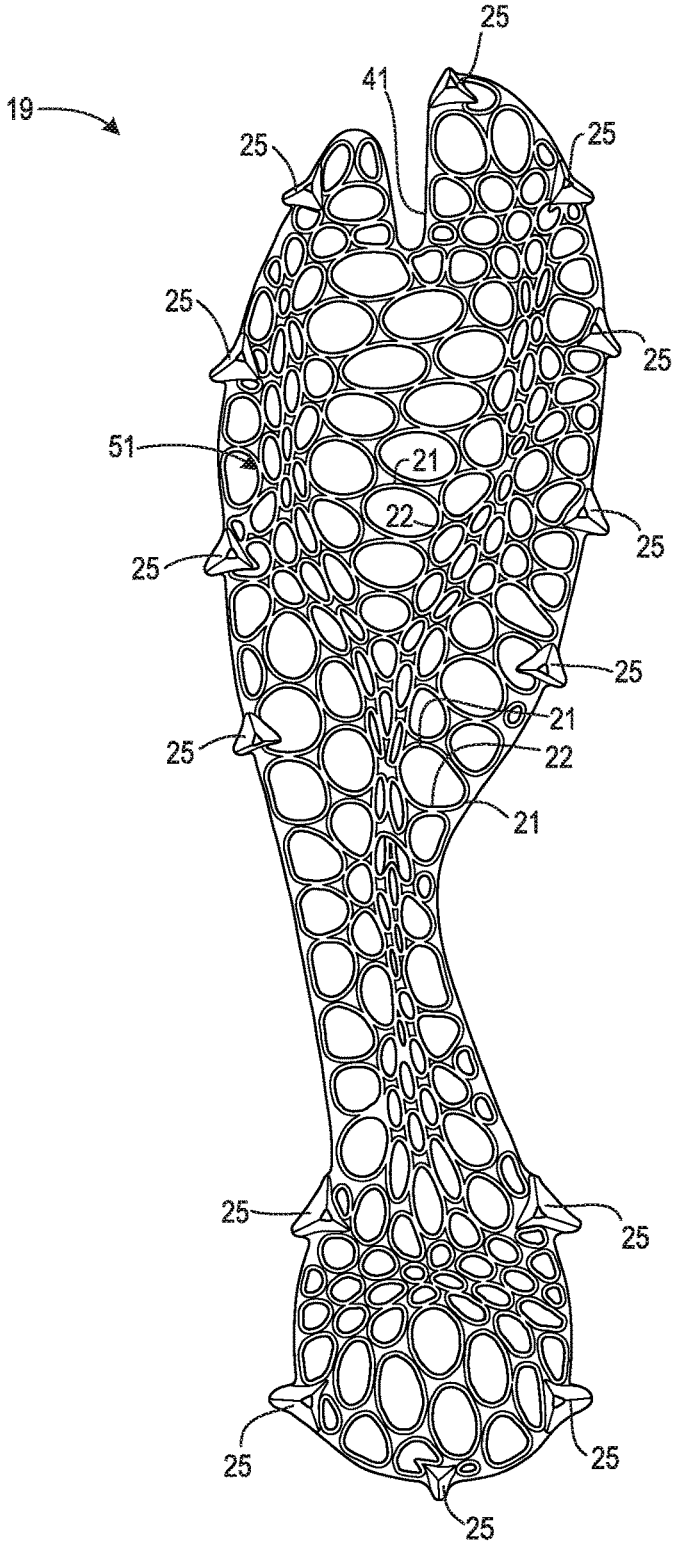
FIG. 4B is a bottom view of the frame from the sole structure of FIGS. 2A-2F.

FIG. 4A is a top view of frame 19 and shows top side 27 of frame 19. FIG. 4B is a bottom view of frame 19 and shows a bottom side 51 of frame 19. Bottom side 51 faces top side 18 of carrier 13 in a completed sole structure 12. In at least some embodiments, frame 19 is formed from a polymer material. Exemplary materials for frame 19 include, without limitation, NYLON, TPU, PEBA, and other thermoplastic or thermoset polymers.

In at least some embodiments, sole structure 13 is formed as a unitary element using a multishot injection molding technique. For example, a portion of carrier 13 without end portions 31 may first be molded, with frame 19 then overmolded onto that portion of carrier 13, and with end portions 31 then overmolded onto the already molded portion of carrier 13. The order of molding various elements may be varied based on materials used. After molding is complete, sole structure 12 is a unitary structure formed from different materials, with each of those materials retaining its own properties.

In embodiments where a midsole is included, that midsole may be formed separate from the carrier and frame and then bonded to the unitary carrier frame.

In at least some embodiments, frame 19 may be formed from a material having a material stiffness greater than that of the second material used to form the portions of carrier 13 other than outsole projection end portions 31. As used herein, material stiffness is distinguished from structural stiffness and refers to inherent stiffness of a material relative to other materials. For material stiffness, a material A is stiffer than a material B if a sample of material A is more resistant to bending or other deformation than a sample of material B having the same size and cross-section as the sample of material A, and when the samples are tested in the same manner. Structural stiffness refers stiffness of a component (or combination of components) that results from both the material(s) of the component(s) and the shape of the component(s). If not otherwise indicated "stiffness" used without the modifier "material" or "structural" refers to structural stiffness.

In some embodiments, a sole structure similar to sole structure 12 may be formed from a single material using single shot injection molding.

As mentioned above, and as further shown in FIGS. 4A and 4B, frame 19 includes a matrix of interconnected walls 21 defining non-uniform cells 22. Cells 22 are open and extend from top side 27 of frame 19 to bottom side 51. Cells 22 vary from each other with regard size, shape, alignment, and/or spacing. Moreover, walls 21 defining those cells 22 have varying thickness and height. As a result, and as discussed more fully below, various regions of frame 19 have increased stiffness and various regions have reduced stiffness.

Several characteristics of cells can be used to better describe features of frame 19. These characteristics are further explained in connection with FIG. 4C1, an enlarged view of the portion of frame 19 indicated in FIG. 4A. Each of cells 22 has a major width $W_{ma}$ representing a width at the widest part of the cell. For example, major widths $W_{ma}$(a) and $W_{ma}$(b) are respectively indicated in FIG. 4C1 for two cells 22*a* and 22*b*. Each of cells 22 also has a minor width $W_{mi}$. A minor width is the largest width of a cell in a direction perpendicular to the direction of the major width for that cell. Minor widths $W_{mi}$(a) and $W_{mi}$(b) are also indicated in FIG. 4C1 for cells 22*a* and 22*b*, respectively. An aspect ratio for a cell may be defined as a ratio of minor width to major width ($W_{mi}/W_{ma}$).

Each of cells 22 also has an orientation angle α. A cell orientation angle is the angle between the major axis direction for that cell and the longitudinal axis LA of sole structure 12. As indicated in FIG. 4C1, cell 22*a* has an orientation angle α(a) and cell 22*b* has an orientation angle α(b). Orientation angle α(a) is substantially transverse, while orientation angle α(b) is substantially longitudinal. An orientation angle may be considered "substantially transverse" if that angle is within 10 degrees of being perpendicular to the longitudinal axis, i.e., if $80 \leq \alpha \leq 100°$. An orientation angle may be considered "substantially longitudinal" if that angle is within 10 degrees of being parallel to the longitudinal axis, i.e., if $-10 \leq \alpha \leq 10°$. An orientation angle may be considered "predominantly longitudinal" if the orientation angle α is between −40° and 40° ($-40 \leq \alpha \leq 40°$). An orientation angle may be considered "predominantly transverse" if the orientation angle α is between 50° and 130° ($50 \leq \alpha \leq 130°$).

FIG. 4C2 is a further enlarged area cross-sectional view from the location indicated in FIG. 4C1 and shows example characteristics of a wall 21. Each wall 21 has a maximum height $h_{max}$ and a thickness $t_{max}$. As seen in more detail in connection with FIGS. 5A-5K, heights and thicknesses of walls 21 vary substantially throughout frame 19. In at least some embodiments, however, most of walls 21 (e.g., more than 80% of all walls 21 in a frame) have sides s that are flat and substantially parallel to one another in a vertical cross-section such as FIG. 4C2.

In the embodiment of shoe 10, frame 19 includes a region of increased stiffness about multiple transverse bending axes. This region 61 is approximately indicated in FIG. 4D1, another top view of frame 19, with a bold broken outline. As seen in FIG. 4D1, region 61 extends through midfoot and forefoot regions of frame 19. A first forefoot branch of region 61 extends along a path that corresponds to the first metatarsal of a shoe 10 wearer. A second forefoot branch of region 61 extends along a path that corresponds to the fifth metatarsal of a shoe 10 wearer. A midfoot branch of region 61 extends from a junction of the forefoot branches and through a midfoot portion of frame 19.

Frame 19 further includes areas of reduced stiffness relative to the stiffness of region 61. For example, and as seen in FIG. 4D2 (another top view of frame 19), a region 63 is located between the forefoot branches of region 61. A region 64 is located on the medial side of region 61 and a region 65 is located on the lateral side of region 61. Various characteristics of cells 22 in regions 63, 64, and 65 result in those regions having less stiffness about transverse bending axes than region 61. As can be seen by comparing FIGS. 4D1 and 4D2, for example, cells 22 in region 63 are much larger and have much higher aspect ratios than cells 22 in region 61. As a result of this and the dimensions ($h_{max}$, $t_{max}$) of walls 21 within region 63, region 63 has substantial flexibility about axes predominantly parallel to the longitudinal axis and about predominantly transverse axes. Conversely, cells 22 in region 61 are smaller, have lower aspect ratios, and have orientation angles that are substantially longitudinal. As a result of this, in conjunction with the dimensions of walls 21 within region 61, region 61 has substantially increased stiffness (relative to region 63), particularly about axes aligned with the orientation directions of cells 22 within region 61.

As also indicated in FIG. 4D2, a region 67 of increased stiffness spans a portion of a heel region of frame 19. Cells 22 in region 67 have smaller areas and are more closely packed than cells 22 to the rear of region 67 or cells 22 in front of region 67.

In general, and for a frame in which most walls have flat and substantially parallel sides, stiffness of that frame about a particular bending axis can be raised in a frame region by increasing the amount of wall material above and/or below that bending axis in a cross-section of the frame passing through the bending axis. For example, for two solid walls having the same area in a vertical sectioning plane, and assuming both walls have straight and substantially parallel sides s, the wall having a higher height to thickness ratio will usually be stiffer about a horizontal bending axis passing through that sectioning plane. In addition to increasing the height to thickness ratio of walls in a particular region, increasing the number of walls in a region will increase stiffness. This can be achieved by, e.g., reducing sizes of cells and/or by orienting cells along a direction perpendicular to expected bending axes.

The stiffness profile of frame 19 is believed, based on finite element analysis, to be particularly desirable for an American style football shoe. Frame 12 merely represents a frame according to one embodiment, however. In other embodiments, one or more other combinations of variations in characteristics of cells and/or walls may create different regions of increased stiffness and/or different regions of reduced stiffness. In this manner, a frame can be "tuned" so as to achieve a desired stiffness profile. Specifically, cell and wall characteristics and be selected so as to achieve desired stiffness and flexibility in regions appropriate for expected foot dynamics in a particular sport or other activity.

Figure 4E:
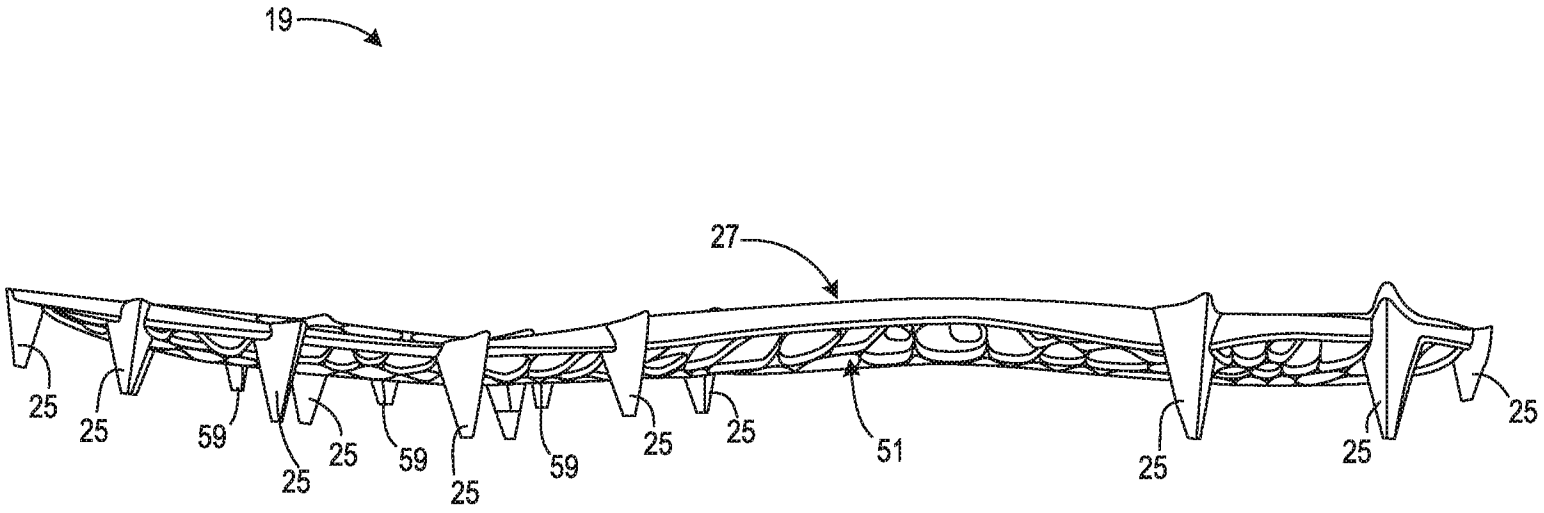
FIG. 4E is a medial side view of the frame from the sole structure of FIGS. 2A-2F.
Figure 4F:
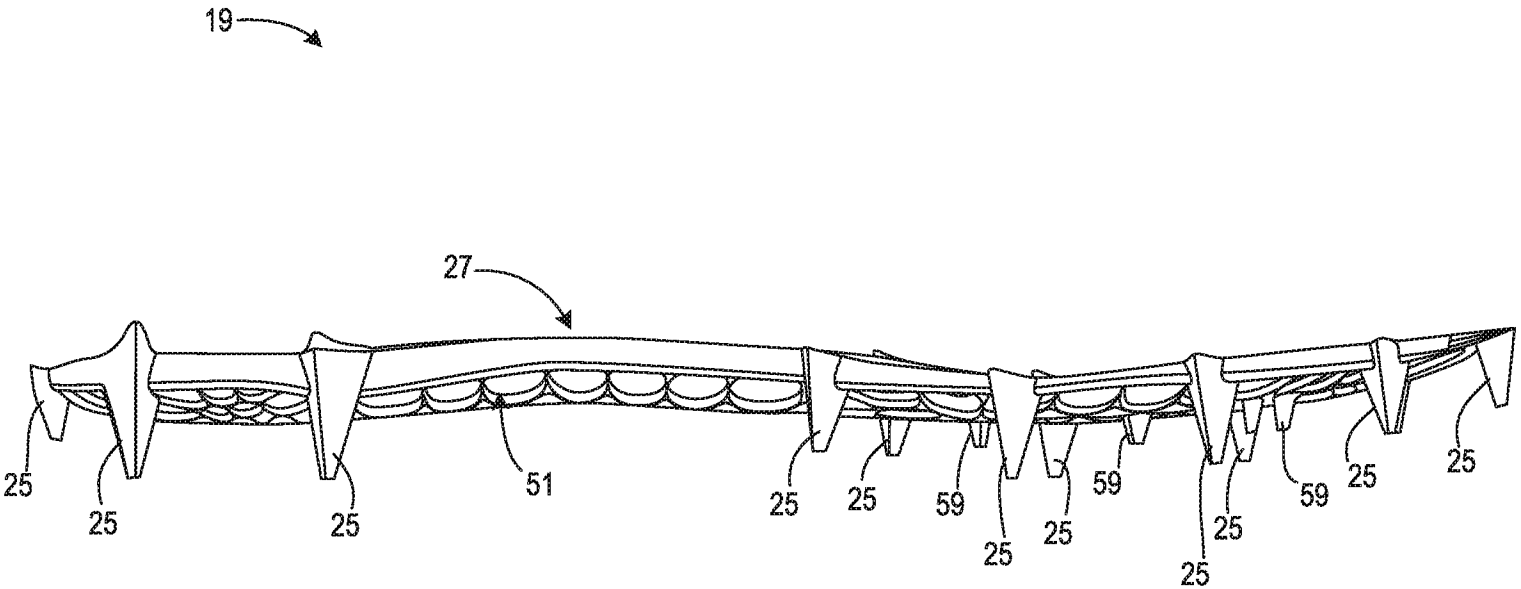
FIG. 4F is a lateral side view of the frame from the sole structure of FIGS. 2A-2F.
Figure 4G:
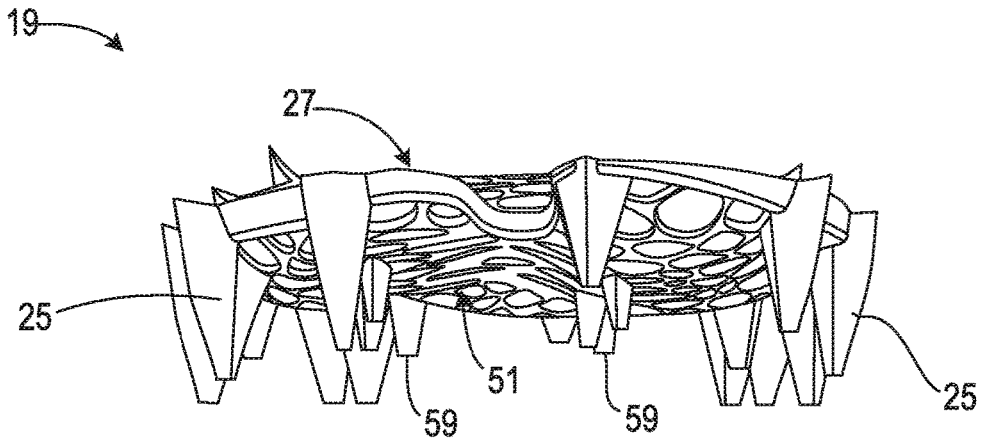
FIG. 4G is a front view showing the toe of the frame from the sole structure of FIGS. 2A-2F.
Figure 4H:
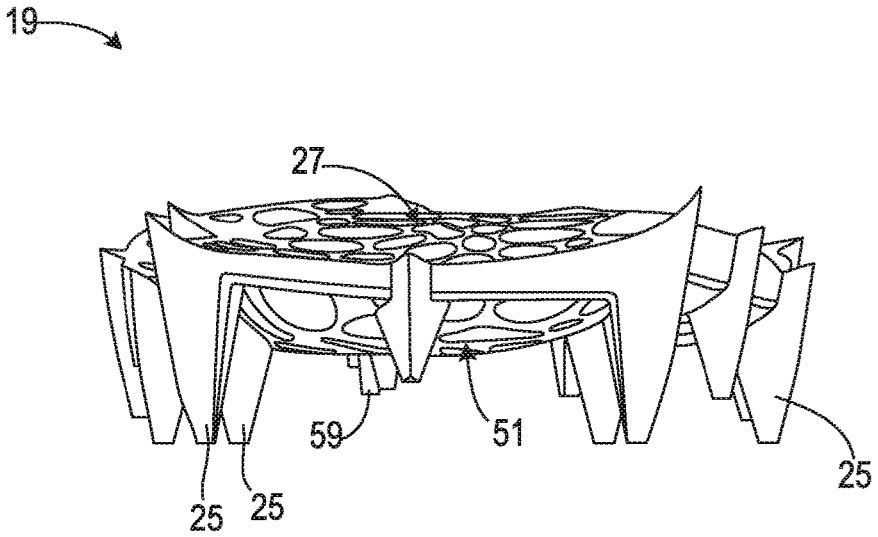
FIG. 4H is a rear view showing the heel of the frame from the sole structure of FIGS. 2A-2F.

FIGS. 4E through 4H show additional details of frame 19. FIG. 4E is a medial side view of frame 19. FIG. 4F is a lateral side view of frame 19. FIG. 4G is a front view showing a toe of frame 19. FIG. 4H is a front view showing a heel of frame 19. As seen in FIGS. 4E through 4H, primary posts 25 have generally pyramidal shapes and extend downward from surrounding regions of the frame 19 bottom side 51. Secondary posts 59 are located in a central forefoot region. Secondary posts 59 are smaller than primary posts 25, but also have generally pyramidal shapes.

FIGS. 5A through 5K are area cross-sectional views taken from the locations indicated in FIGS. 2E and 2F. In FIGS. 5A through 5K, a first cross-hatching pattern is used to indicate the material of frame 19, a second cross-hatching pattern is used to indicate the material of portions of carrier 13 other than end portions 31, and stippling is used to indicate the material of end portions 31. As seen in FIGS. 5A through 5K, the top of frame 19 is generally shaped to conform to and support the plantar surface of the foot of a shoe 10 wearer. In particular, the tops of most walls 21 generally align with a contour indicated by broken line P. Edges and an arch region of carrier 13 also align with this contour.

FIGS. 5A-5C, 5E-5G, 5I, and 5K show examples of a primary post 25 extending into and reinforcing a primary outsole projection 16. Each primary outsole projection 16 includes a base portion 32 and an end portion 31. Each base portion 32 is a boss that extends downward from surrounding regions of the carrier 13 bottom side 17. Each end portion 31 is attached to the bottom of a top portion 32. A primary opening 35 extends through each top portion 32 and end portion 31. Each primary post 25 fills the primary receptacle 35 of the primary outsole projection 16 to which that post 25 corresponds. In this manner, posts may 25 reinforce and provide additional stiffness to projections 16. This may be particularly advantageous in embodiments in with a carrier material has a material stiffness less than that of the frame material.

Figure 5A:
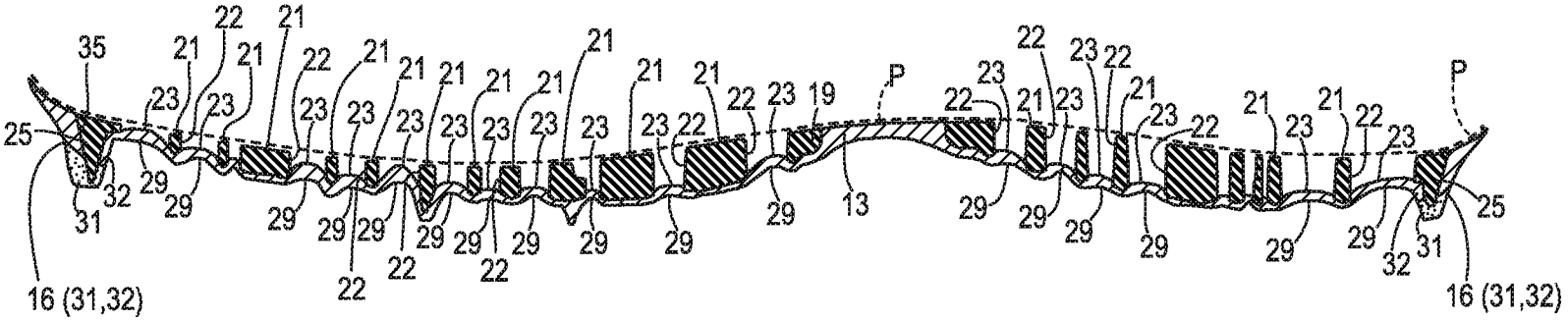
FIGS. 5A through 5K are area cross-sectional views taken from the locations indicated in FIGS. 2E and 2F.
Figure 5B:
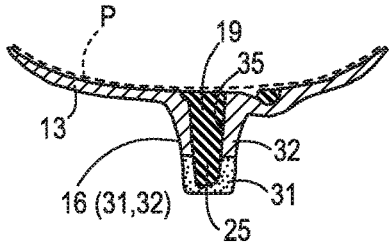
Figure 5C:
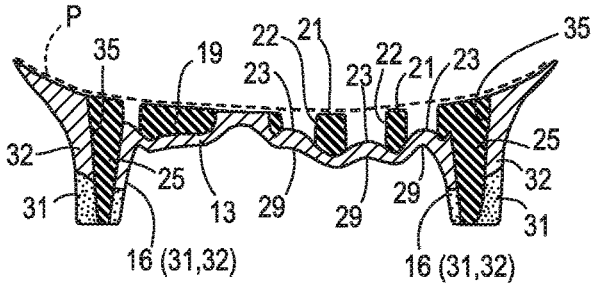
Figure 5D:
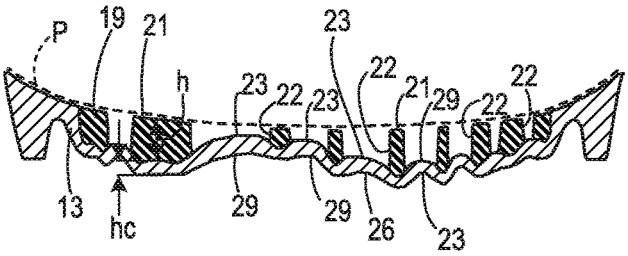
Figure 5E:
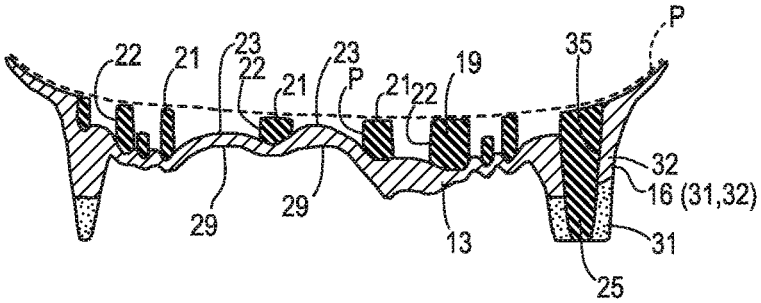
Figure 5F:
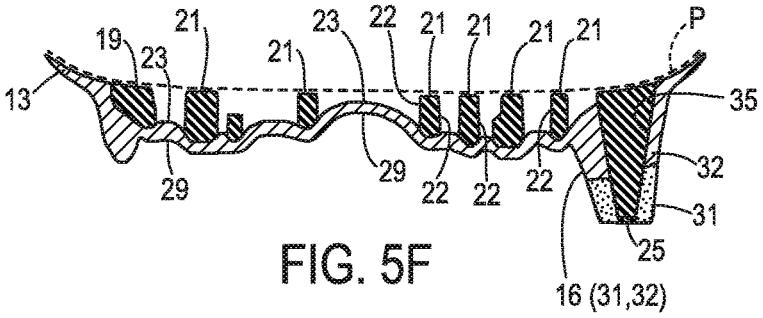
Figure 5G:
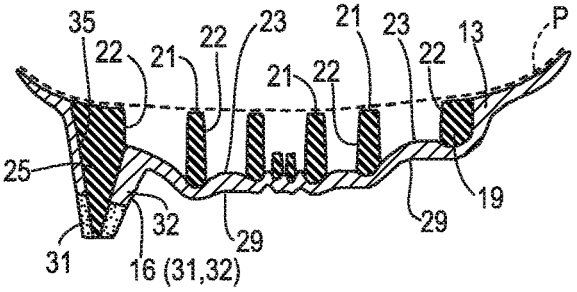
Figure 5H:
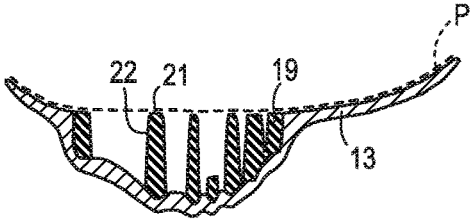
Figure 5I:
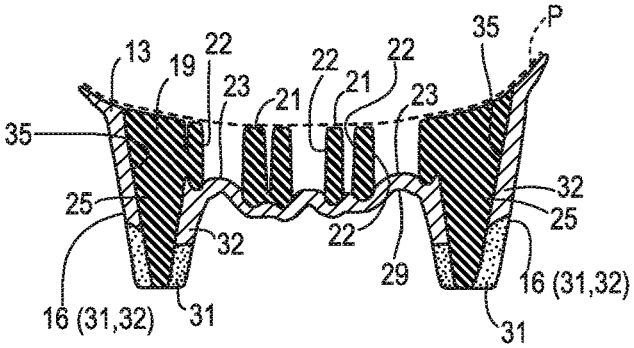
Figure 5J:
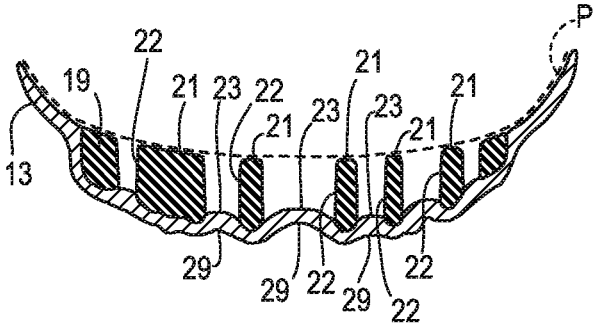
Figure 5K:
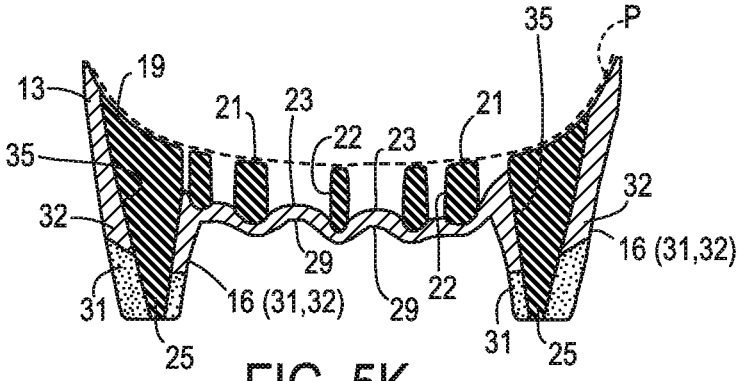

Although the thickness of carrier 13 varies, the height hc of carrier 13 in a given location is generally significantly less than the height h of the rib 21 directly above that carrier 13 portion. An example of this is indicated in FIG. 5D. In some embodiments, and for most (e.g., 80%) of ribs 21 in a frame, ribs have local heights h that are at least twice the local height hc of the carrier portion directly under the rib portion having height h. In this manner, a carrier can function similar to a "skin" that protects a frame from damage and that prevents dirt, turf, or other debris from accumulating in cells, but that has less impact on overall sole structure stiffness than the frame (particularly when softer carrier materials are employed). In turn, this may permit more accurate tuning of a stiffness profile based on frame design.

This configuration is also believed to create a mechanical self-cleaning action on bottom side 17 of carrier 13. During activity, mud and other debris may tend to accumulate in and/or adhere to exposed surfaces of concavities 29. As sole structure 13 bends and flexes, however, concavities 29 will be partially flattened. It is believed that this will tend to disrupt adhesion of debris to the exposed surfaces of concavities 29 and the ridges defining concavities 29.

Other embodiments include numerous additional variations on the components and combinations described above. Without limitation, such variations may include one or more of the following.

In some embodiments, a sole structure may incorporate metal components in an outsole projection. For example, and for a shoe intended for wear by a baseball player, metal cleats can be placed into a mold and the sole structure then injection molded around those cleats.

All cells need not be completely open. In some embodiments, for example, cells may include a flange or other feature extending across some or all of the cell.

A frame need not include posts that extend through outsole projections on a carrier, or posts may only extend partially through outsole projections.

A carrier need not include outsole projections.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from herein-described embodiments are the within the scope of the invention. In the example embodiments included in the following list of example embodiments, a reference to a potential or intended wearer or a user of a component does not require actual wearing or using of the component or the presence of the wearer or user as part of the example embodiment.

For the avoidance of doubt, the present application includes the subject-matter described in the following numbered paragraphs (referred to as "para." or "paras."):

1. A sole structure for an article of footwear, comprising:
   a carrier having a bottom side and a top side; and
   a frame attached to the carrier top side and including interconnected walls defining a plurality of cells.
2. The sole structure of para. 1, wherein at least some of the cells are varied with respect to at least one of size, shape, alignment, and spacing, and/or wherein at least some of the walls are varied with respect to wall height and wall thickness, so as to define one or more regions of increased stiffness and one or more regions of reduced stiffness.
3. The sole structure of any of paras. 1 or 2, wherein the carrier has a shape corresponding to at least a portion of a footwear sole.
4. The sole structure of any of paras. 1 through 3, wherein at least a portion of the carrier comprises a first material and the frame is formed from a second material different from the first material, and wherein the second material has a material stiffness greater than a material stiffness of the first material.
5. The sole structure of any of paras. 1 through 4, wherein the at least a portion of the carrier extends under the cells.
6. The sole structure of any of paras. 1 through 5, wherein the cells are open and expose regions of the carrier top side within the cells.
7. The sole structure of any of paras. 1 through 6, wherein the carrier top side includes a plurality of protrusions, each of the protrusions extending into a corresponding one of the cells.
8. The sole structure of para. 7, wherein each of the protrusions has a shape matching a shape of its corresponding cell.
9. The sole structure of any of paras. 1 through 8, wherein the carrier includes a plurality of concavities on an exposed portion of the bottom side.
10. The sole structure of para. 9, wherein each of the concavities corresponds to and is positioned under a different cell of the plurality.

11. The sole structure of any of paras. 1 through 10, wherein the frame comprises posts extending downward from surrounding portions of a bottom side of the frame, each of the posts into the carrier.

12. The sole structure of para. 11, wherein the carrier bottom side includes a plurality of projections extending downward from surrounding portions of the carrier bottom side, and wherein each of posts extends through one of the projections.

13. The sole structure of any of paras. 1 through 12, wherein the frame has peripheral boundary contained within a peripheral boundary of the carrier.

14. The sole structure of any of paras. 1 through 13, wherein the frame extends through forefoot, midfoot, and heel regions.

15. The sole structure of any of paras. 1 through 14, wherein the carrier extends through forefoot, midfoot, and heel regions.

16. The sole structure of any of paras. 1 through 15, wherein a forefoot portion of the carrier includes a interphalangeal region gap.

17. The sole structure of para. 16, wherein the carrier top side includes a ridge nested within the interphalangeal region gap.

18. The sole structure of any of paras. 1 through 17, wherein one or more regions of increased stiffness in the frame include a region of increased stiffness about multiple transverse axes.

19. The sole structure of para. 18, wherein the region of increased stiffness about multiple transverse axes extends through forefoot and midfoot portions of the frame.

20. The sole structure of para. 19, wherein the region of increased stiffness about multiple transverse axes includes a first branch extending through a first metatarsal region, a second branch extending through a fifth metatarsal region, and a midfoot branch extending from a junction of the first and second branches and through the midfoot portion of the frame.

21. The sole structure of any of paras. 1 through 20, wherein the sole structure is a unitary element.

22. The sole structure of para. 21, wherein the sole structure is formed by injection molding, and wherein the frame comprises a first material and the carrier comprises a second material different from the first material.

23. The sole structure of para. 21, wherein the sole structure is formed by injection molding, and wherein the frame and carrier are formed from a single material.

24. The sole structure of any of paras. 1 through 23, wherein the carrier overlays at least a portion of the cells.

25. The sole structure of any of paras. 1 through 24, wherein the frame comprises first and second regions, wherein the cells and/or walls of the first region have a configuration different from a configuration of the cells and/or walls of the second region, and wherein the first region has a stiffness different from a stiffness of the second region as a result of the difference between the configuration of the cells and/or walls of the first region and the configuration of the cells and/or walls of the second region.

26. The sole structure of any of paras. 1 through 25, wherein the cells are non-uniform.

27. An article of footwear, comprising:

an upper; and the sole structure of any of paras. 1 through 26 coupled to the upper.

The invention claimed is:

1. A sole structure for an article of footwear, comprising:

a carrier having a bottom side and a top side, the carrier comprising a portion located in a forefoot region of the sole structure, a portion located in a midfoot region of the sole structure, and a portion located in a heel region of the sole structure; and a frame attached to the carrier top side and comprising interconnected walls defining a plurality of cells, and wherein at least some of the cells are varied with respect to at least one of size, shape, alignment, and spacing, and at least some of the walls are varied with respect to wall height and wall thickness, so as to define one or more regions of increased stiffness in the frame and one or more regions of reduced stiffness in the frame, at least parts of the portions of the carrier extend under the cells, and the one or more regions of increased stiffness comprise a region of increased stiffness about multiple transverse axes, the region of increased stiffness about multiple transverse axes extending through forefoot and midfoot portions of the frame and comprising a first branch extending through a first metatarsal region, a second branch extending through a fifth metatarsal region, and a midfoot branch extending from a junction of the first and second branches and through the midfoot portion of the frame.

2. The sole structure of claim 1, wherein the portions of the carrier comprise a first material and the frame is formed from a second material different from the first material, and wherein the second material has a material stiffness greater than a material stiffness of the first material.

3. The sole structure of claim 1, wherein a forefoot portion of the frame comprises an interphalangeal region gap, and wherein the carrier top side includes a ridge nested within the interphalangeal region gap.

4. The sole structure of claim 1, wherein the cells are open and expose regions of the carrier top side within the cells.

5. The sole structure of claim 1, wherein the carrier top side includes comprises a plurality of protrusions, each of the protrusions extending into a corresponding one of the cells.

6. The sole structure of claim 5, wherein each of the protrusions has a shape matching a shape of its corresponding cell.

7. The sole structure of claim 6, wherein the carrier comprises a plurality of concavities exposed on the bottom side, and wherein each of the concavities corresponds to and is positioned under a different cell of the plurality.

8. The sole structure of claim 1, wherein the frame comprises posts extending downward from surrounding portions of a bottom side of the frame, wherein the carrier bottom side comprises a plurality of projections extending downward from surrounding portions of the carrier bottom side, and wherein each of posts extends through one of the projections.

9. The sole structure of claim 1, wherein the frame has a peripheral boundary contained within a peripheral boundary of the carrier.

10. The sole structure of claim 1, wherein the frame extends through the forefoot, the midfoot, and the heel regions of the sole structure.

11. The sole structure of claim 1, wherein the sole structure is a unitary element.

12. The sole structure of claim 11, wherein the sole structure is formed by injection molding, and wherein the frame comprises a first material and the carrier comprises a second material different from the first material.

13. The sole structure of claim 11, wherein the sole structure is formed by injection molding, and wherein the frame and carrier are formed from a single material.

14. The sole structure of claim 1, wherein the frame comprises first and second regions, wherein the cells and/or walls of the first region have a configuration different from a configuration of the cells and/or walls of the second region, and wherein the first region has a stiffness different from a stiffness of the second region as a result of the difference between the configuration of the cells and/or walls of the first region and the configuration of the cells and/or walls of the second region.

15. An article of footwear, comprising:

an upper; and the sole structure of claim 1 coupled to the upper.

16. The sole structure of claim 1, wherein an outermost edge of the carrier defines an outer boundary of the sole structure.

17. The sole structure of claim 1, wherein the one or more regions of reduced stiffness comprise a second region located on medial sides of the first branch and the midfoot branch, a third region located on lateral sides of the second branch and the midfoot branch, and a fourth region located between the first and second branches, and cells in the region of increased stiffness are smaller than cells in the second, third, and fourth regions.

18. The sole structure of claim 17, wherein orientation angles of the cells in the region of increased stiffness are substantially longitudinal.

19. The sole structure of claim 1, wherein, for each of most of the walls of the frame, the wall has a local height that is at least twice a local height of a portion of the carrier under the wall.

20. The sole structure of claim 1, wherein the carrier extends from a medial side of the sole structure to a lateral side of the sole structure in the forefoot, the midfoot and the heel regions of the sole structure.

21. The sole structure of claim 20, wherein the carrier extends from a toe region of the sole structure to the heel region of the sole structure.

* * * * *